US005732423A

United States Patent [19]

Weismiller et al.

[11] Patent Number: 5,732,423

[45] Date of Patent: Mar. 31, 1998

[54] BED SIDE RAILS

[75] Inventors: Matthew W. Weismiller, Batesville, Ind.; Joseph A. Kummer, Cincinnati, Ohio; Peter M. Wukusick, Batesville; Kenneth L. Kramer, St. Paul, both of Ind.; Philip D. Palermo, Celina; Daniel F. Dlugos, Jr., West Chester, both of Ohio; David A. Albersmeyer, Batesville; Jason C. Brooke, Greensburg, both of Ind.

[73] Assignee: Hill-Rom, Inc., Batesville, Ind.

[21] Appl. No.: 511,360

[22] Filed: Aug. 4, 1995

[51] Int. Cl.[6] ..... A47C 21/08

[52] U.S. Cl. ..... 5/425; 5/424; 5/618; 5/658; 5/430

[58] Field of Search ..... 5/427, 430, 425, 5/428, 600, 602, 617, 618, 624, 610, 181, 185, 411, 186.1, 460, 503.1, 658

[56] References Cited

U.S. PATENT DOCUMENTS

| | | | |
|---|---|---|---|
| D. 336,577 | 6/1993 | Celestina et al. . | |
| 2,722,017 | 11/1955 | Burst et al. . | |
| 3,506,989 | 4/1970 | Ross et al. . | |
| 3,585,659 | 6/1971 | Burst et al. . | |
| 3,932,903 | 1/1976 | Adams et al. . | |
| 4,183,015 | 1/1980 | Drew et al. | 5/425 |
| 4,205,665 | 6/1980 | Burton | 128/68 |
| 4,369,535 | 1/1983 | Ekkevind | 5/481 |
| 4,653,129 | 3/1987 | Kuck et al. | 5/430 |
| 4,680,790 | 7/1987 | Packard et al. | 5/658 |
| 4,847,929 | 7/1989 | Pupovic | 5/618 |
| 4,912,787 | 4/1990 | Bradcovich | 5/617 |
| 5,083,334 | 1/1992 | Huck et al. . | |
| 5,129,117 | 7/1992 | Celestina | 5/430 |
| 5,179,744 | 1/1993 | Foster et al. . | |
| 5,205,004 | 4/1993 | Hayes et al. . | |
| 5,269,388 | 12/1993 | Reichow et al. | 5/600 |
| 5,276,010 | 1/1994 | Ferrand et al. . | |
| 5,370,111 | 12/1994 | Reeder et al. | 5/503.1 |
| 5,394,580 | 3/1995 | Foster et al. . | |
| 5,454,126 | 10/1995 | Foster et al. | 5/600 |
| 5,542,138 | 8/1996 | Williams et al. | 5/658 |

*Primary Examiner*—Steven N. Meyers
*Assistant Examiner*—Fredrick Conley
*Attorney, Agent, or Firm*—Barnes & Thornburg

[57] ABSTRACT

A chair bed for supporting a person is provided, the chair bed having a head end, afoot end, and opposing sides. The chair bed includes a frame and a deck supported on the frame. The deck includes head, seat, and foot sections. A mattress is mounted on the deck and has an upwardly-facing patient surface. The mattress also has head, seat, and foot portions corresponding, respectively, to the head, seat, and foot sections of the deck. The head section of the deck and the mattress portion thereon is pivotable from a generally horizontal down position through various positions upwardly to a back-support position. A pair of side rails is mounted on each side of the chair bed. Each pair of side rails includes a body section side rail mounted to move with the deck seat section and extending laterally adjacent the deck head and seat sections and a head section side rail mounted to move with the deck head section relative to the body section side rail and extending adjacent only the deck head section.

41 Claims, 10 Drawing Sheets

BED SIDE RAILS

BACKGROUND AND SUMMARY OF THE INVENTION

The present invention relates to bed side rails, and particularly to side rails for a hospital bed or a patient-care bed. More particularly, the present invention relates to side rails for a hospital bed or a patient-care bed which is convertible to a chair so that the bed can be manipulated to achieve both a conventional bed position having a horizontal sleeping surface and a sitting position having the feet of the person on or adjacent to the floor and the head and back of the person supported above a seat formed by the bed.

Many hospital beds are positionable to a configuration having the sleeping surface of the bed at a predetermined height above the floor and having side rails positioned to restrain the movement of a person lying on the sleeping surface past sides of the sleeping surface and off of the bed. The sleeping surfaces of many such hospital beds can typically be lowered to reduce the distance between the sleeping surface and the floor, and the sleeping surfaces of such beds can often be manipulated to adjust the position of the person on the sleeping surface. In addition, the side rails of these hospital beds can typically be moved to a position away from the sleeping surface to facilitate movement of the person on the sleeping surface from the supine position on the sleeping surface to a standing position on the floor near the bed.

Beds and examination tables having side rails to restrain the movement of the person on the support surfaces thereof past the sides of the support surfaces are known in the art. See, for example, U.S. Pat. Nos. 5,077,843 to Foster L. Dale et al., 5,157,800 to Borders, and 5,129,177 to Celestina et al., all of which are assigned to the assignee of the present invention, and U.S. Pat. No. 5,279,010 to Ferrand et al. Each of these references discloses a bed or an examination table having side rails. See also U.S. patent application Ser. No. unknown, filed herewith, to Weismiller et al. and entitled Chair Bed, the specification of which is herein incorporated by reference.

According to the present invention, a bed for supporting a person is provided, the bed having a head end, a foot end, opposite sides, and including a unique side rail arrangement. The bed has a frame and a deck supported on the frame, the deck comprising head, seat, and foot sections. A mattress is mounted on the deck to cushion the person. The mattress has an upwardly-facing support surface and head, seat, and foot portions corresponding, respectively, to the head, seat, and foot sections of the deck.

The head section of the deck and the mattress portion thereon are pivotable relative to the frame from a generally horizontal position through various positions upwardly to a back-support position. The foot section of the deck and the mattress portion thereon are pivotable from a generally horizontal up position through various positions downwardly to a generally vertically downwardly extending down position providing clearance for the lower legs of the person.

The bed further includes a pair of side rails on each side of said bed. Each pair of side rails includes a body section side rail mounted to move with the deck seat section. The body section side rail extends adjacent to the deck head and body sections. Each pair of side rails also includes a head section side rail mounted to move with the deck head section relative to the body section side rail. The head section side rail extends adjacent to only the deck head section. Each side rail has a top and a bottom and is preferably maintained in a generally vertical orientation adjacent to the sides of the bed.

In preferred embodiments, the bed includes a base frame, an intermediate frame coupled to the base frame, a weigh frame coupled to the intermediate frame, and an articulating deck coupled to the weigh frame. The articulating deck has longitudinally spaced head, seat, thigh, and foot sections. The head, thigh, and foot sections are movable relative to each other and are movable relative to the seat section which is fixed relative to the weigh frame. The head, thigh, and foot sections are infinitely adjustable to allow the bed to attain any desired position within the range of movement of the head, thigh, and foot sections, thus accommodating changes of position of a person on the bed. The illustrative articulating deck can provide a planar, horizontal sleeping surface, a planar sleeping surface that is tilted toward either the head end of the bed or the foot end of the bed, and a non-planar chair-shaped seating surface, in addition to the intermediate positions therebetween. Further, as will be described in more detail hereinafter, the illustrative and preferred deck is a "step deck" in that it has an upper deck formed to include a central, longitudinally extending recess defined by a lower deck and side walls connecting the lower and upper decks.

The head section side rails are typically mounted to move with the head section of the articulating deck and move with the head section as the head section moves between the down position and the back-support position. The body section side rails are fixed relative to the weigh frame. The head section and body section side rails are configured to maintain a between-rail gap of approximately 2–3 inches (5.1–7.6 cm) as the head section side rail moves relative to the body section side rail. Also in preferred embodiments, the head section side rails are shorter than the body section side rails and shorter than typical side rails making it possible for a person to enter the bed from the side using the head section side rail as a support and to properly position his or her hip on the sleeping surface.

The side rails are each movable between an upward patient-restraining position restraining the movement of a person supported on the sleeping surface past the sides of the sleeping surface and a downward tucked position. When in the patient-restraining position, the bottoms of the side rails are positioned to lie above the upper deck side portions and the side rails abut sides of the mattress. When in the tucked position, the tops of the side rails are positioned to lie beneath the upper deck side portions in a niche defined by the upper deck side portions and the side walls connecting the lower deck to the upper deck side portions.

When moving between the patient-restraining position and the tucked position, the side rails rotate outwardly and downwardly from the patient-restraining position away from the side of the bed, and then back inwardly and downwardly to the tucked position beneath the upper deck portion. The side rails trace the same path when moving from the tucked position to the patient-restraining position. The rotating mechanism, which holds the side rails in vertical orientations parallel to the side of the mattress through the entire range of movement, places the side rails against the sides of the mattress when the side rails are in the patient-restraining position, allowing for the provision of a narrower bed than would otherwise be provided, even though the mattress of the bed has a standard width.

It is still another object of the present invention to provide a bed with cooperating step deck and side rail features. The bed has a head end, a foot end, and two opposing sides, and comprises a frame and a deck carried by the frame. The deck includes an upper deck portion and a central, longitudinally extending recess in the upper deck portion. The recess is defined by a lower deck portion and walls connecting the lower and upper deck portions. The bed further includes a side rail coupled to the bed below the upper deck portion and positionable in a patient-restraining position above the upper deck portion and in a tucked position below the upper deck portion. When the side rails are in the tucked position, clearance between the side rails and the floor is maximized. The positioning of the side rails beneath the deck when in the tucked position also helps caregivers to improve the positioning of the person when moving the person in and out of bed.

The mattress of the bed includes a thin mattress portion engaging the upper deck portions along the sides of the deck and a thicker mattress portion in areas of the mattress that carry a greater portion of the weight of the person while the person is carried by the bed. As a result, the upper deck side portions are typically farther from the floor than the bottom of the step deck. This allows the side rails to be mounted farther from the floor than would be found on a bed without a step deck. This positioning provides additional obstruction-free space between the side rails and the floor for access under the deck, for example, for equipment such as a C-arm having portions above and below the deck.

In addition, when the side rails are in the patient-restraining position, the distance between the bottom of each side rail and the top of each upper deck portion is minimized when a step deck is used. The side rails are positioned above the deck and abut the side of the mattress. A bed having a conventional deck, a conventional mattress of uniform thickness, and side rails mounted at a height relative to the sleeping surface similar to that found in the bed of the present invention would also have the bottoms of the side rails further from the conventional deck than is found in the present invention, resulting in a larger gap between the bottom of the side rail and the conventional deck. Use of the step deck provides upper deck portions which are positioned to lie closer to the bottoms of the side rails, thus minimizing the gap between the deck and the bottoms of the side rails and minimizing the possibility of a person sliding through the gap.

It is also an object of the present invention to provide a bed having a head end, a foot end, sides, and a breakaway side rail feature. The bed includes a deck having an elongated collateral deck member pivotably coupled to the deck for movement between an up position generally parallel to the first side of the bed and a generally vertically downwardly extending down-out-of-the-way position. A side rail is connected to and moves with the collateral deck member between the up position and the down-out-of-the-way position. In preferred embodiments, then, the side rail rotates between the patient-restraining position and the tucked position and also swings between the tucked position and the down-out-of-the-way position when the collateral deck member swings between the up position and the down-out-of-the-way position.

In preferred embodiments, such a bed comprises side rails on each side of the bed including head section side rails movable with the head section of the deck and body section side rails associated with the seat section of the deck. These side rails are movable from positions above the mattress to positions below the mattress. The bed can be configured so that the head section side rails can swing to the down-out-of-the-way position and the body section side rails cannot swing to the down-out-of-the-way position.

Each of these "breakaway side rails" swings from the tucked position, in which the top of the side rail is positioned to lie beneath the sleeping surface, to the down-out-of-the-way position, in which the mounting bracket and the side rail are positioned to lie vertically adjacent to the head end of the bed. When the breakaway side rail is in the down-out-of-the-way position, the caregiver's access to the portion of the bed beneath the step deck is maximized. This access can also be used to maximize the reach across the step deck of a C-arm carrying equipment such as X-ray photography equipment, the C-arm typically having portions of the equipment both above and below the step deck.

It is further an object of the present invention to provide a bed for supporting a person, the bed having mechanical angle indicators uniquely mounted on the side rails. The bed has a head, a foot, and opposing sides and includes an articulated deck having a first side and a second side. A mattress having an upwardly-facing support surface with a first side and a second side is supported above the deck. A side rail is coupled to the side of the deck and is positionable in a patient-restraining position restraining the movement of the person supported on the bed past the side of the support surface. An angle indicator is connected to the side rail to indicate the angular orientation of the side rail relative to the floor.

In preferred embodiments, the articulating deck has a head section that is movable between a generally horizontal down position and an upward back-supporting position providing a pivotable backrest. The head section side rail can carry the angle indicator and can be connected to the head section side rail so that, as the head section pivots between the down position and the back-support position, the side rail and the angle indicator connected thereto also move. As the angle indicator moves, it provides indications that vary with the position of the head section. Placement of the angle indicator on the side rail thus provides a readily visible indication for the caregiver of the angular orientation of the angle indicator, and thus the position of the head section.

In addition, the deck can be supported by a frame that is supported above and movable relative to a base. The side rail can be coupled to the frame so that the side rail and the angle indicator move as the frame moves relative to the base. The angle indicator can be configured to provide indications that vary with the position of the frame. Having the angle indicator on the body section side rail provides a readily visible indicator for the caregiver of the position of the frame, and hence of the deck and the sleeping surface supported thereon relative to the floor.

It is a further object of the present invention to provide a bed including unique side rail mounted controls. The bed has a head, a foot, and opposing sides. The bed includes an articulated deck having a first side and a second side and a mattress supported on the deck. The mattress has an upwardly-facing support surface, a first side, and a second side. A side rail is coupled to the side of the deck and the bed is further provided with a first plurality of first control buttons on a bed side of the side rail for use by a person in the bed. The bed is also provided with a second plurality of second buttons on an outside of the side rail for use by a person outside of the bed.

A display screen can be provided on one or both sides of the side rail. Preferably, the display screen is mounted to the side rail to pivot outwardly for easy viewing. For example, the display screen can be mounted to the outside of the side rail for use by a person outside of the bed and can be configured to pivot upwardly about a pivot axis adjacent to the top of the display screen. Such a display screen would allow for easy viewing of the display screen by a person standing next to the bed even when the side rail is in the downward tucked position.

Additionally, the plurality of control buttons on the bed side of the side rail can each have a face that is inclined with respect to a plane of the side rail toward the head end of the bed. This angling of the buttons allows for easy viewing of the faces of the buttons by a person lying on the sleeping surface of the bed.

It is also an object of the present invention to provide a bed including a unique hip pivot guide. The bed has a generally planar bed position and is convertible to a sitting position permitting the person to egress from the foot end thereof. The chair bed includes a base and a deck mounted on the base and including at least head, seat, and foot sections movable relative to each other between a generally planar bed position and a raised sitting position. A mattress is mounted on the deck and has an upwardly-facing support surface and head, seat, and foot portions corresponding, respectively, to and moving with said head, seat, and foot sections of said deck. Indicia are provided on the platform indicating the position of the hip of a person on the patient-support surface in the planar position.

Additional objects, features, and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE ILLUSTRATIVE AND PREFERRED EMBODIMENTS

Figure 1:
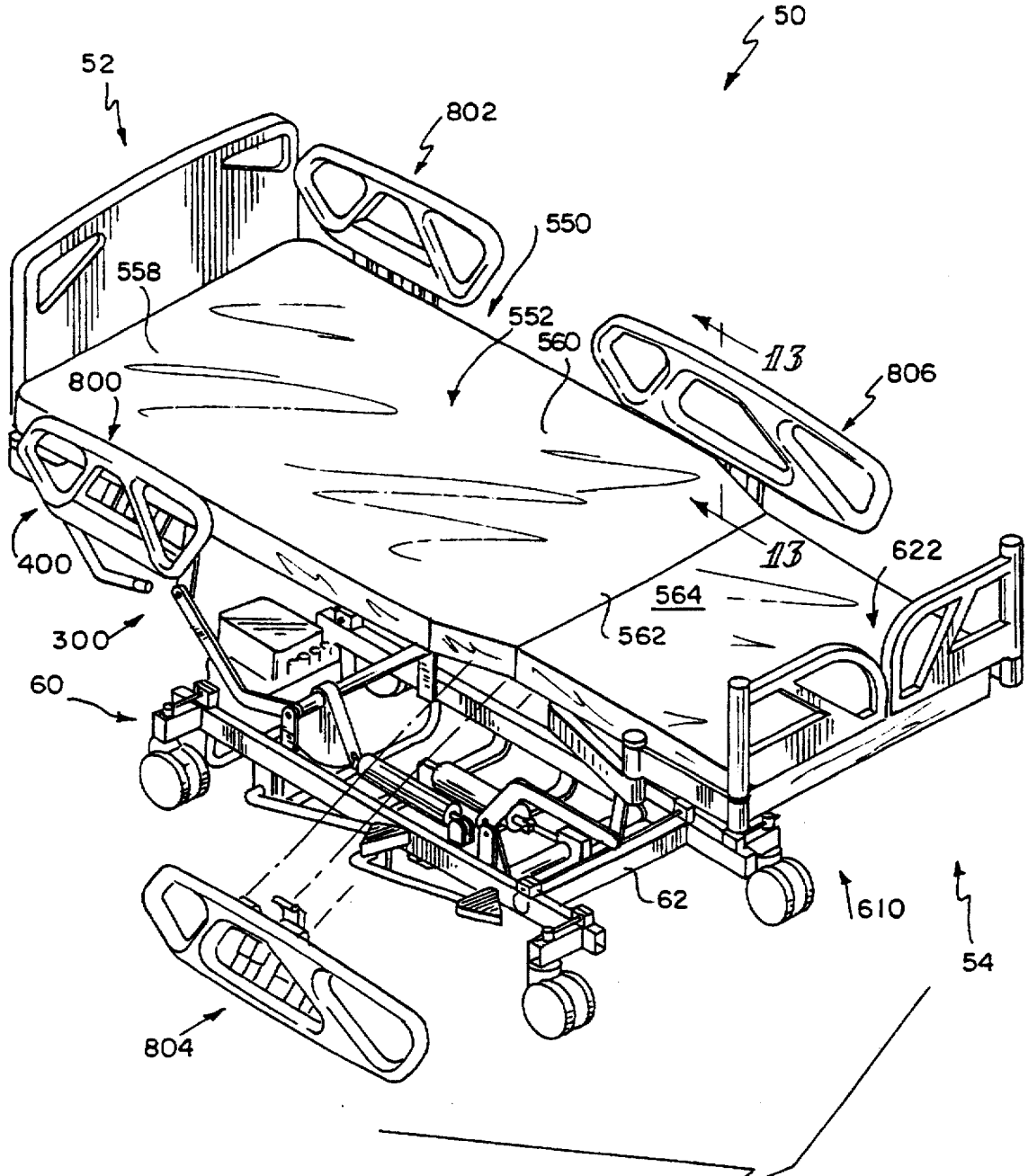
FIG. 1 is a perspective view of a chair bed in accordance with the present invention showing a body section side rail exploded away from the chair bed, head section side rails and body section side rails positioned along longitudinal sides of the deck, and a swinging foot gate in a closed position.

A chair bed 50 in accordance with the present invention having a head end 52, a foot end 54, and sides 56, 58 is illustrated in FIG. 1. As used in this description, the phrase "head end 52" will be used to denote the end of any referred-to object that is positioned to lie nearest head end 52 of chair bed 50. Likewise, the phrase "foot end 54" will be used to denote the end of any referred-to object that is positioned to lie nearest foot end 54 of chair bed 50.

Figure 9:
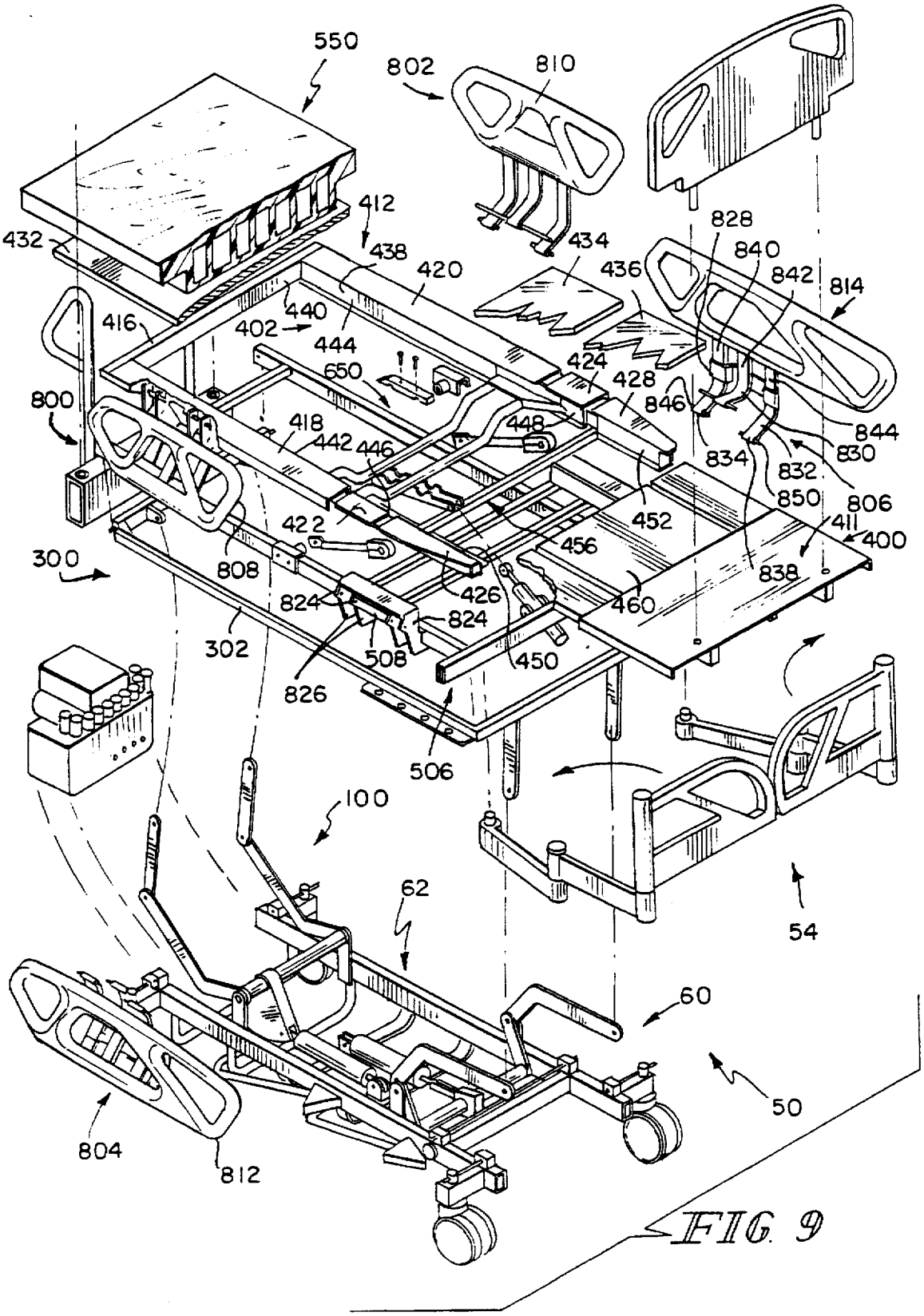
FIG. 9 is an exploded perspective view of the chair bed of FIG. 1 with portions broken away.

Chair bed 50 includes a base module 60 having a base frame 62 connected to an intermediate frame module 300 by lift arms 320, 322, 324, 326 as shown in FIGS. 1, and 9. An articulating deck/weigh frame module 400 is coupled to intermediate frame module 300 by load beams (not shown). Side rail assemblies 800, 802, 804, 806 and an extended frame module 610 having a swinging foot gate 622 are coupled to articulating deck/weigh frame module 400. A mattress 550 is carried by articulating deck/weigh frame module 400 and provides a sleeping surface or support surface 552 configured to receive a person (not shown).

Chair bed 50 can be manipulated by a caregiver or by a person (not shown) on sleeping surface 552 using hydraulic system module 100 so that mattress 550, an intermediate frame 302 of intermediate frame module 300, and an articulating deck 402 of articulating deck/weigh frame module 400 assume a variety of positions, several of which are shown diagrammatically in FIGS. 3–8.

Articulating deck 402 includes a head section 404, a seat section 406, a thigh section 408, and a foot section 410. Mattress 550 rests on deck 402 and includes a head portion 558, a seat portion 560, a thigh portion 562, and a foot portion 564, each of which generally corresponds to the like-named portions of deck 402, and each of which is generally associated with the head, seat, thighs, and feet of the person on sleeping surface 552. Details of deck 402 and mattress 550 will be explained hereinafter.

Figure 3:
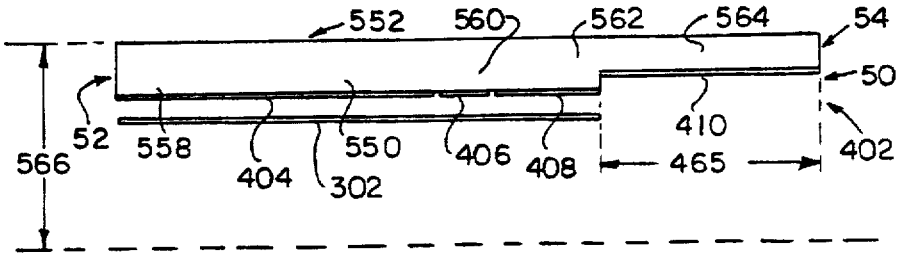
FIG. 3 is a diagrammatic view of the chair bed of FIG. 1 showing the chair bed in a bed position including a mattress having an upwardly-facing sleeping surface held a predetermined first distance above the floor, the deck being in an initial position supporting the sleeping surface in a generally planar configuration, and the foot section being a first length.
Figure 4:
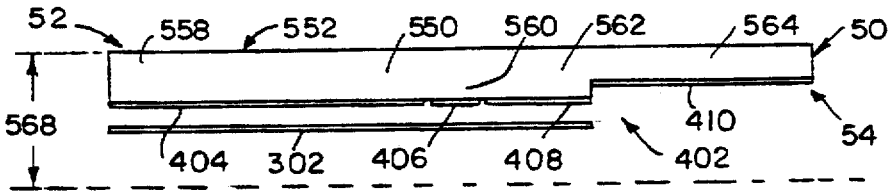
FIG. 4 is a diagrammatic view showing the chair bed in a low position.

Chair bed 50 can assume a bed position having deck 402 configured so that sleeping surface 552 is planar and horizontal, defining an initial position of deck 402 as shown in FIG. 1 and as shown diagrammatically in FIG. 3. In the bed position, sleeping surface 552 is a predetermined first distance 566 above the floor. Chair bed 50 can also be manipulated to assume a low position shown diagrammatically in FIG. 4 having deck 402 in the initial position and having sleeping surface 552 a predetermined second distance 568 above the floor, the second distance 568 being smaller than first distance 566. The foot section 410 of the articulating deck 402 has a first length 465 when the deck 402 is in the initial position.

Figure 5:
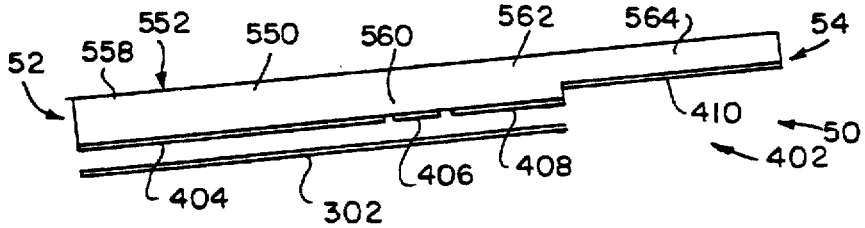
FIG. 5 is a diagrammatic view showing the chair bed in a Trendelenburg position.
Figure 6:
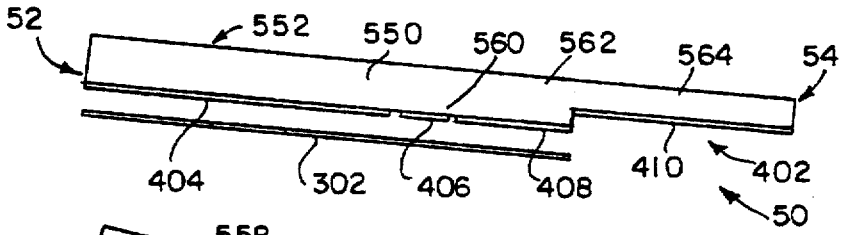
FIG. 6 is a diagrammatic view showing the chair bed in a reverse Trendelenburg position.
Figure 7:
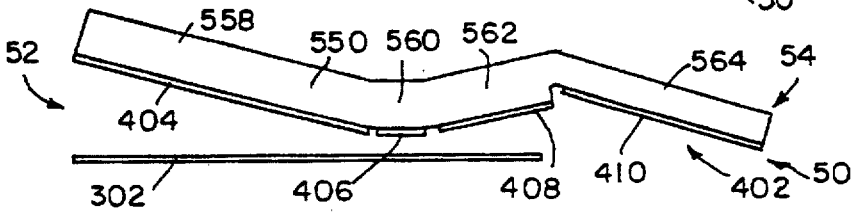
FIG. 7 is a diagrammatic view showing the chair bed in an intermediate position having a head end of a head section of the deck pivoted slightly upward from the initial position of the deck, a seat section positioned to lie in the horizontal plane defined by the seat section in the initial position of the deck, and the foot section being inclined slightly so that the foot end of the foot section lies below the position of the foot section when the deck is in the initial position of the deck.

Chair bed 50 can be moved to a Trendelenburg position shown diagrammatically in FIG. 5 having deck 402 in a planar configuration and tilted so that head end 52 of sleeping surface 552 is positioned to lie closer to the floor than foot end 54 of sleeping surface 552. Chair bed 550 can also achieve a reverse Trendelenburg position shown diagrammatically in FIG. 6 having deck 402 in a planar configuration and tilted so that foot end 54 of sleeping surface 552 is positioned to lie closer to the floor than head end 52 of sleeping surface 552.

Figure 2:
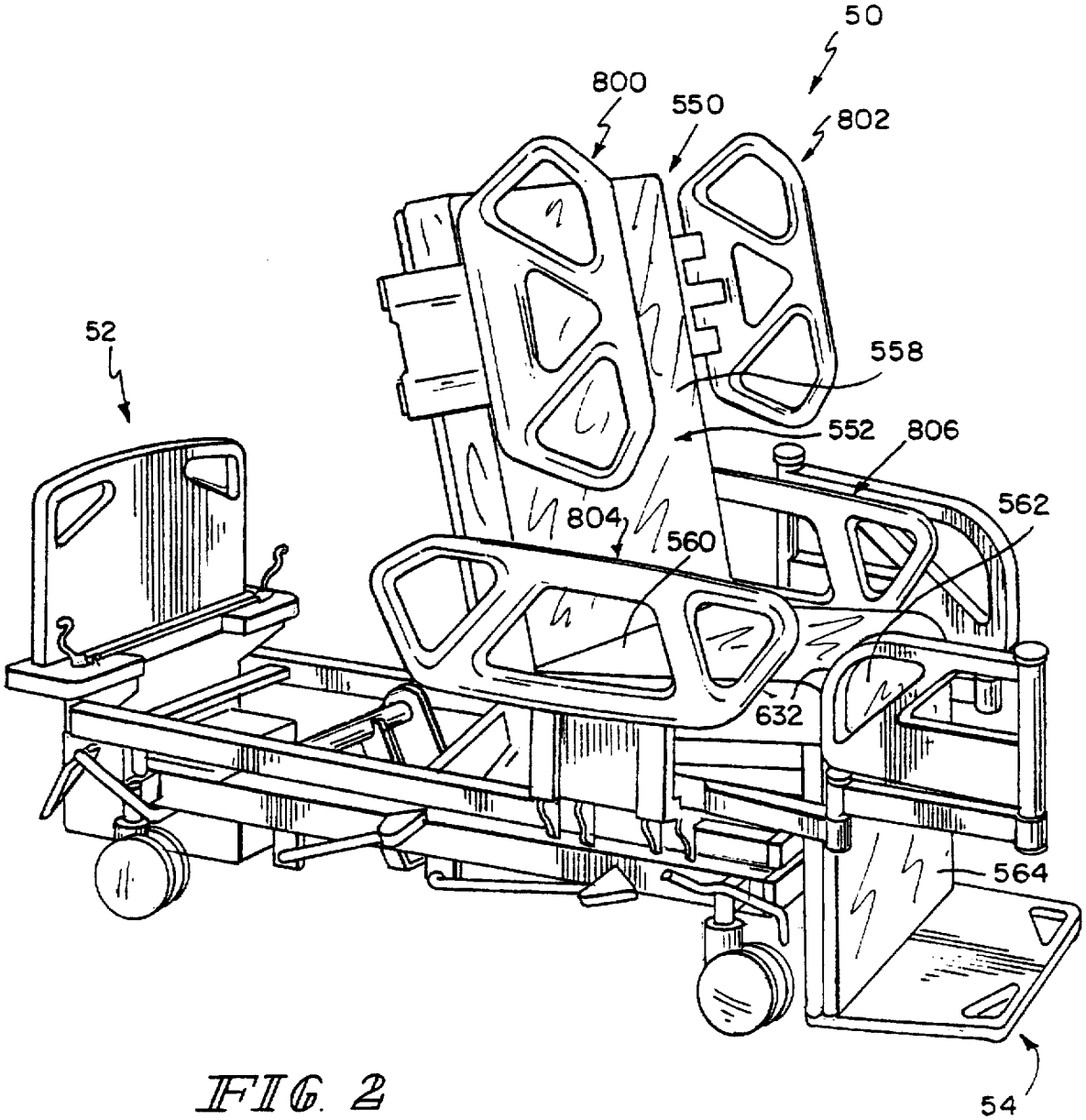
FIG. 2 is a view similar to FIG. 1 showing the chair bed in the sitting position having a head section of an articulating deck moved upwardly to a back-support position, a thigh section of the deck inclined slightly upwardly, a foot section of the deck moved to a generally vertical downwardly extending down position, a foot portion of the mattress being deflated, and swinging gates moved to an open position with one swinging gate folded next to the chair bed.
Figure 8:
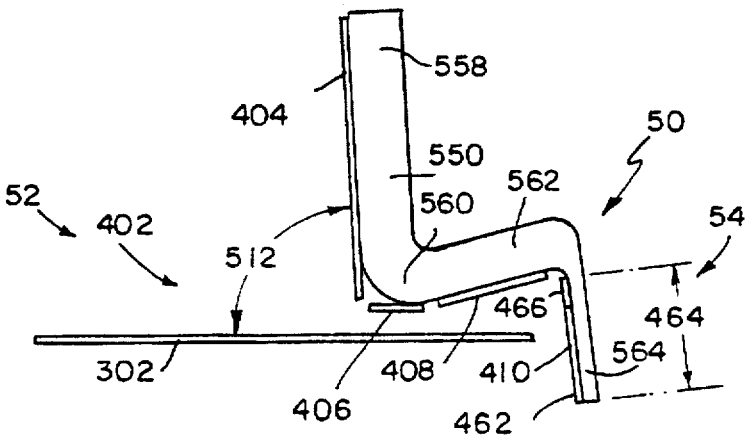
FIG. 8 is a diagrammatic view showing the chair bed in a sitting or chair position with the head end of the head section pivoted upwardly away from the seat section to a back-support position, the seat section lying generally horizontal as in the initial deck position, the thigh section being raised upwardly, the foot section extending downwardly from the thigh section and being a second shorter length, and the portion of the mattress over the foot section being deflated.

As described above, chair bed 50 is convertible to a sitting position shown in FIG. 2 and shown diagrammatically in FIG. 8. In the sitting position, head end 52 of head section 404 of deck 402 is pivoted upwardly away from intermediate frame 302 to a back-support position providing a pivotable backrest so that head section 404 and intermediate frame 302 form an angle 512 generally between 55 and 90 degrees. Seat section 406 of deck 402 is positioned to lie generally horizontally as in the initial position, foot end 54 of thigh section 408 is slightly upwardly inclined, and foot section 410 of deck 402 extends generally vertically downwardly from thigh section 408 and has a length 464 that is shorter than when deck 402 is in the initial position. Foot portion 564 of mattress 550 is inflatable and is in a deflated condition when chair bed 50 is in the sitting position. Foot portion 564 of mattress 550 is thinner and shorter when deflated than when inflated.

Chair bed 50 is capable of assuming positions in which head, thigh, and foot sections 404, 408, 410 of deck 402 are in positions intermediate to those shown in FIGS. 3 and 8. For example, chair bed 50 can assume an intermediate position shown diagrammatically in FIG. 7 having head end 52 of head section 404 of deck 402 pivoted slightly upwardly from the initial position, seat section 406 positioned to lie in the same generally horizontal plane as in the initial position, foot end 54 of thigh section 408 raised slightly upwardly from the initial position, and foot section 410 being inclined so that foot end 54 of foot section 410 lies below head end 52 of foot section 410.

Articulating Deck/Weigh Frame Module 400 includes mattress 550 that rests on four sections, head section 404, seat section 406, thigh section 408, and foot section 410 of articulating deck 402 as shown in FIGS. 3–9. The sections 404, 406, 408, 410 of articulating deck 402 are movable to change the position of a person supported on sleeping surface 552 of mattress 550.

Side Rail Assemblies 800, 802, 804, 806 include side rails 808, 810, 812, 814, which are passive restraint devices mounted on both sides of chair bed 50 as shown in FIGS. 1, 2, and 13–15. In the upward patient-restraining position, side rails 808, 810, 812, 814 are vertical barriers extending above sleeping surface 552 to restrain movement of the person past sides 554, 556 of sleeping surface 552, thereby preventing the person from rolling out of chair bed 50. Side rails 808, 810, 812, 814 may also be lowered below sleeping surface 552 of mattress 550 to permit the person to move past sides 554, 556 of sleeping surface 552 when entering and exiting chair bed 50 or to give the caregiver clear access to the patient.

Lowering each side rail 808, 810, 812, 814 is accomplished by pulling a release handle 862. After pulling release handle 862, the caregiver may let go of release handle 862 and allow side rail 808, 810, 812, 814 to rotate downwardly and tuck into the tucked position under deck 402. The rate at which each side rail 808, 810, 812, 814 rotates downwardly is preferably controlled by a mechanical damper 868. To raise side rails 808, 810, 812, 814, the caregiver pulls upwardly on side rails 808, 810, 812, 814 until they lock in the patient-restraining position.

Illustratively, there are four side rails 808, 810, 812, 814 on chair bed 50. Two head section side rails 808, 810 are mounted to head section 404 of articulating deck 402, and two body section side rails 812, 814 are mounted to move or stay with seat section 406 of deck 402, seat section 406 and side rails 812, 814 being fixed relative to weigh frame 506.

Side rails 808, 810, 812, 814 can be provided with mechanical angle indicators 938 that provide a visual indication of the angular orientation of side rails 808, 810, 812, 814 relative to the floor. Head section side rails 808, 810 move with head section 404 of deck 402 as head section 404 pivots between the down position and the back-support position, so that angle indicators 938 mounted to head section side rails 808, 810 generally indicate the angular orientation of head section 404. Likewise, body section side rails 812, 814 are generally fixed in an angular orientation relative to intermediate frame 302 so that angle indicators 938 mounted to body section side rails 812, 814 generally indicate the angular orientation of intermediate frame 302.

Figure 12:
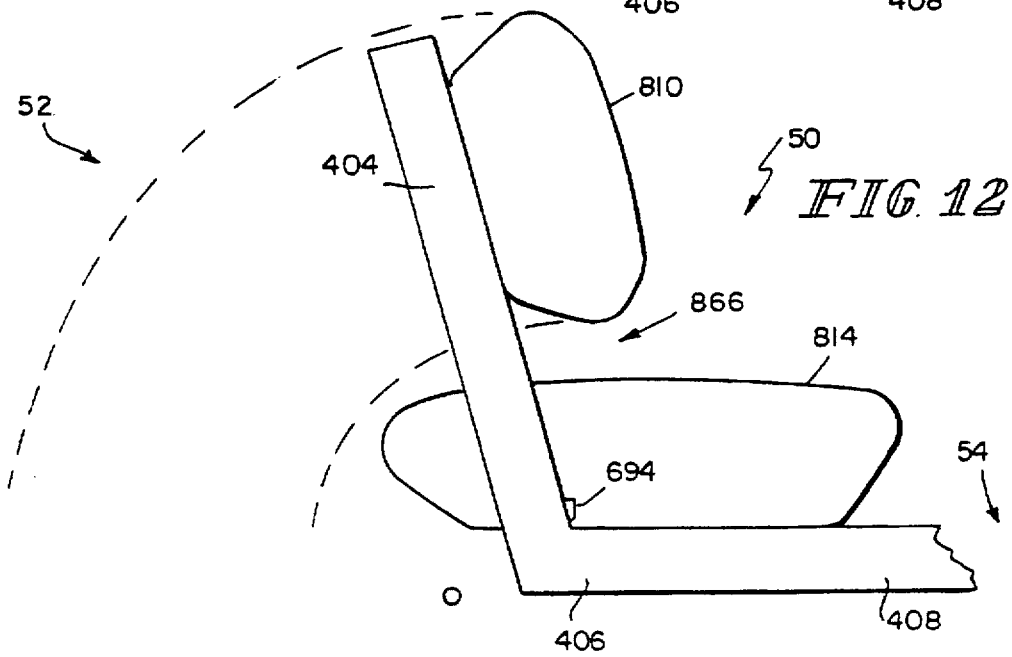
FIG. 12 is a diagrammatic view similar to FIG. 10 showing the head section in the back-support position of FIG. 8.
Figure 13:
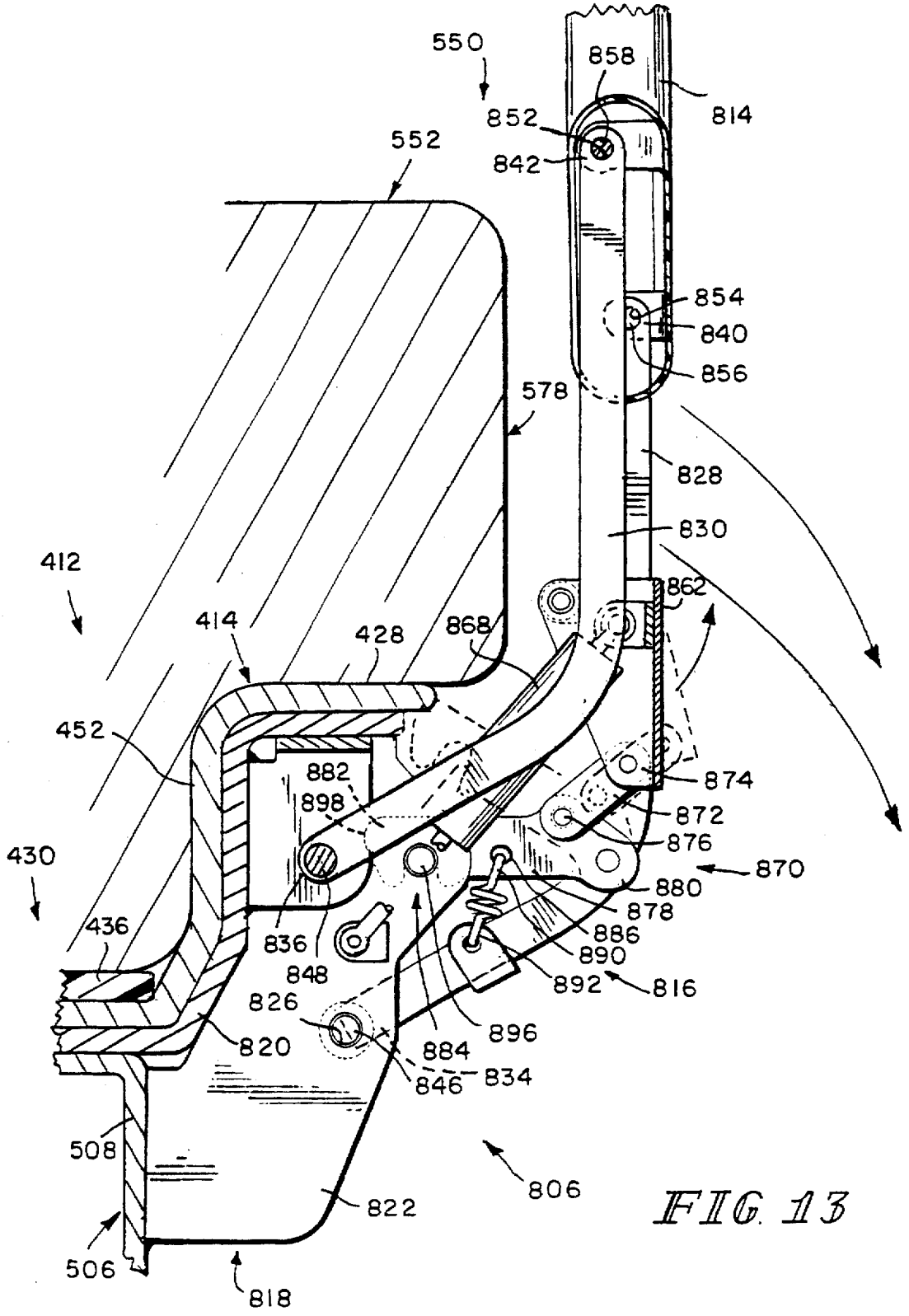
FIG. 13 is a sectional view taken along line 13—13 of FIG. 1 of a side rail in a patient-restraining position.
Figure 14:
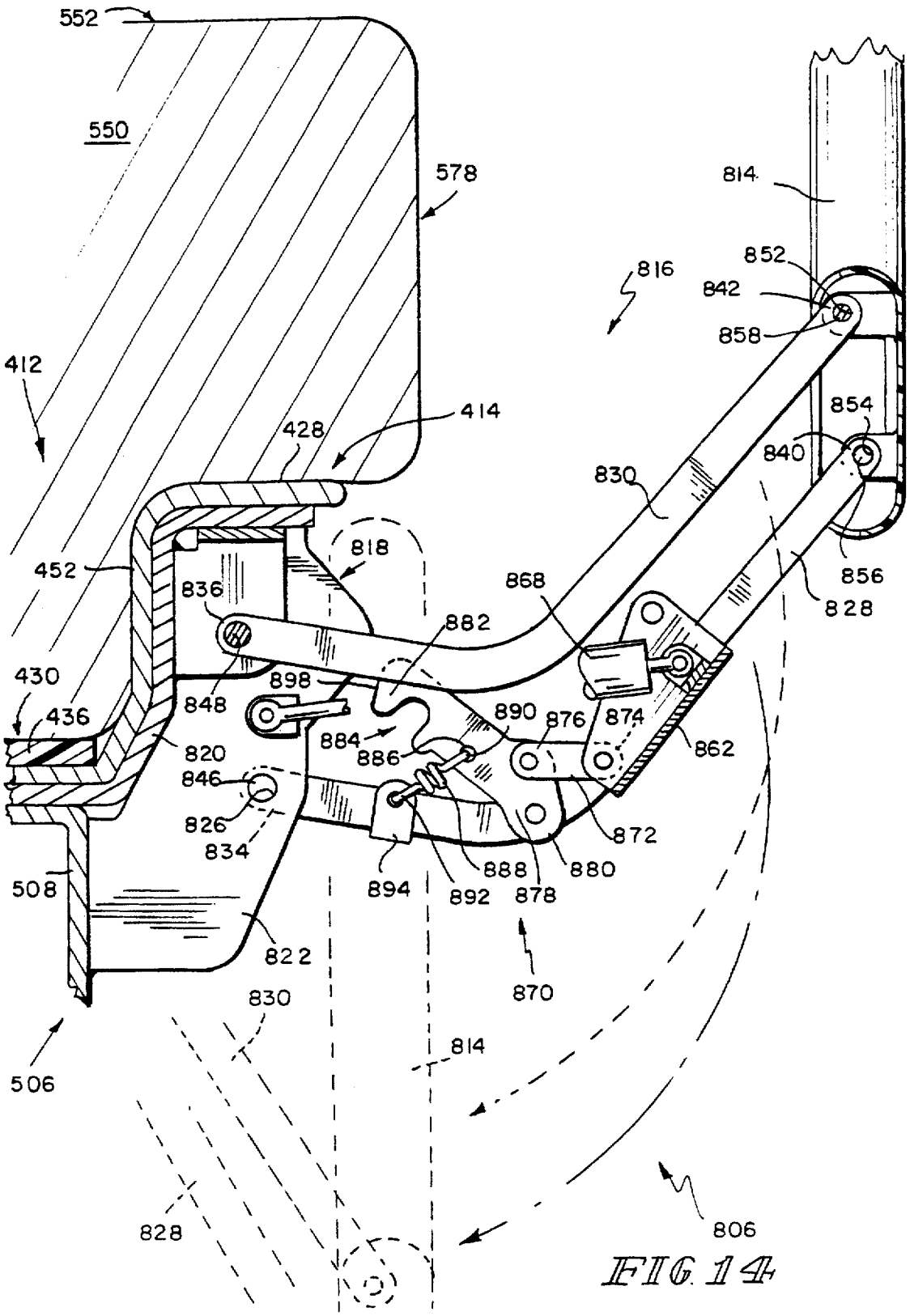
FIG. 14 is a view similar to FIG. 13 of the side rail intermediate the patient-restraining position of FIG. 13 and a down-out-of-the-way position (in phantom) having a top of the side rail beneath the sleeping surface.

Body section side rails 812, 814 can also be provided with a hip pivot guide 694 shown in FIGS. 12–14 to help the caregiver to properly position the hip (not shown) of the person (not shown) on sleeping surface 552. Proper positioning of the hip operates to maximize the effectiveness of the reduced-shear pivot.

Besides serving as passive restraints, side rails 808, 810, 812, 814 also serve as a mounting location for nurse controls 1028, 1030, patient controls 1156, 1160 and entertainment modules. These modules are referred to as human interface control modules. These interface control modules output the occurrence of any switch activation into the electronic network. In addition, side rails 808, 810, 812, 814 may preferably contain the necessary hardware to allow patient-to-nurse communications (not shown) and entertainment audio output (not shown).

The head, seat, thigh, and foot sections 404, 406, 408, 410 of articulating deck 402 cooperate to define a step deck 412 as shown best in FIGS. 9, and 13–15. Step deck 412 includes an upper deck 414 having a head end upper deck portion 416 appended to head end 52 of head section 404, side upper deck portions 418, 420, 422, 424, 426, 428 appended to sides of the head, seat, and thigh sections 404, 406, 408, and a foot end upper deck portion 460 appended to foot end 54 of weigh frame 506 adjacent to thigh section 408. The upper deck portions 416, 418, 420, 422, 424, 426, 428, 460 and a top surface 411 of foot section 410 are coplanar when articulating deck 402 is in the initial position and cooperate to form upper deck 414 which is generally parallel to weigh frame 506.

Step deck 412 also includes a lower deck 430 having a head slat 432, a seat slat 434, and a thigh slat 436. Head, seat, and thigh slats 432, 434, 436, are coplanar when articulating deck 402 is in the initial position and they cooperate to form lower deck 430 which is generally parallel to weigh frame 506 and to upper deck 414 when articulating deck 402 is in the initial position.

Lower deck 430 is connected to upper deck 414 by a wall 438 including a head end wall 440 connecting head slat 432 to head end upper deck portion 416, side walls 442, 444, 446, 448, 450, 452 connecting head, seat, and thigh slats 432, 434, 436 to side upper deck portions 418, 420, 422, 424, 426, 428, and a foot end wall (now shown) connecting thigh slat 436 to foot end upper deck portion 460 as shown in FIG. 9. Step deck 412, then, comprises upper deck 414 and is formed to include a central, longitudinally extending recess 456 defined by lower deck 430 and by wall 438 connecting lower deck 430 to upper deck 414. In the preferred embodiment, foot section 410 of step deck 412 is displaced from recess 456 and forms part of upper deck 414, as shown in FIGS. 28 and 30.

Upper deck side portions 417 cooperate with mattress 550 to define "rammed" edges that provide greater firmness around the edges of sleeping surf-ace 552 as the result of sleeping surface 552 being in close proximity to upper deck 414. This increased firmness is advantageous when the person enters and exits the bed along the sides of the bed.

Additionally, the rammed edges provide a firm edge that cooperates with side rail assemblies 800, 802, 804, 806 to minimize the potential for side rail entrapment, in which an object becomes wedged between sleeping surface 552 and one of side rails 808, 810, 812, 814. Also, step deck 412 cooperates with side rail assemblies 800, 802, 804, 806 to maximize the height relative to sleeping surface 552 at which side rails 808, 810, 812, 814 are mounted as shown in FIGS. 13 and 14. Tops of side rails 808, 810, 812, 814 can be higher when in the patient-restraining position for improved coverage and protection of the person (not shown) on sleeping surface 552 and bottoms 814 can be higher when in the tucked position for improved access to base frame 62 and to the space beneath intermediate frame 302.

Head section 404 is coupled to weigh frame 506 by reduced-shear pivot assembly 650 shown in FIG. 9. Reduced-shear pivot assembly 650 mounts head section 404 to weigh frame 506 for both translational movement and pivoting movement of head section 404 relative to seat section 406 of deck 402 and relative to weigh frame 506. The pivoting and translational movements combine to produce a motion in which head section 404 pivots relative to weigh frame 506 about an effective pivot axis positioned to lie above lower deck 430 and immediately adjacent upper deck 414. The shear between the back of the person and the sleeping surface 552 caused by movement of head section 404 is reduced, thereby reducing scrubbing of the sleeping surface 552 against the person.

Figure 10:
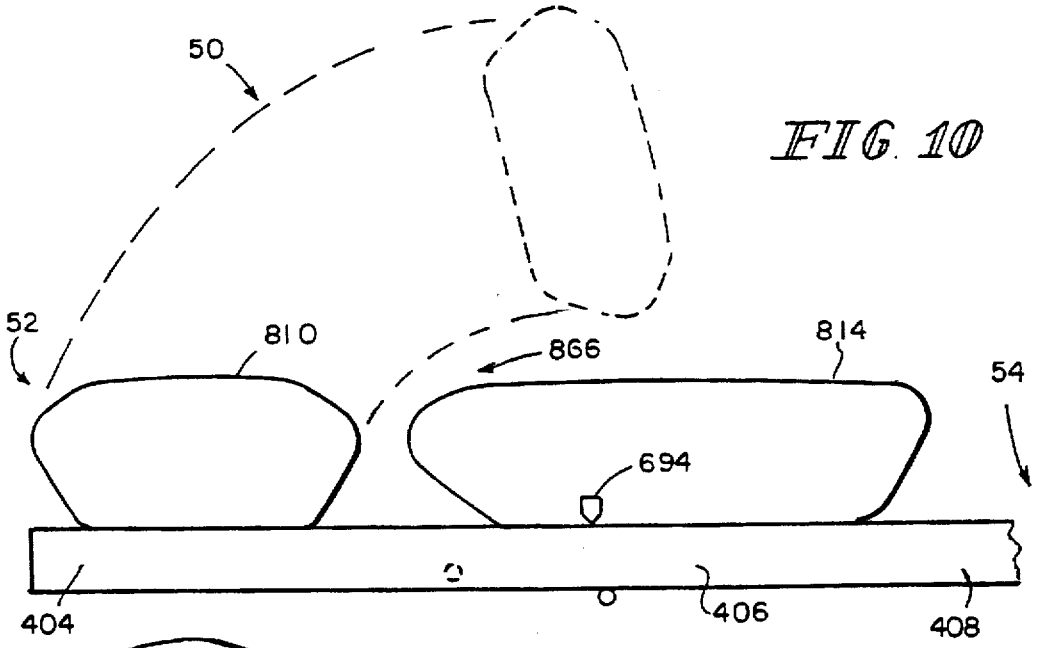
FIG. 10 is a diagrammatic side elevation view of the chair bed of FIG. 1 showing the chair bed in the bed position of FIG. 3 and showing a head section side rail and a body section side rail.
Figure 11:
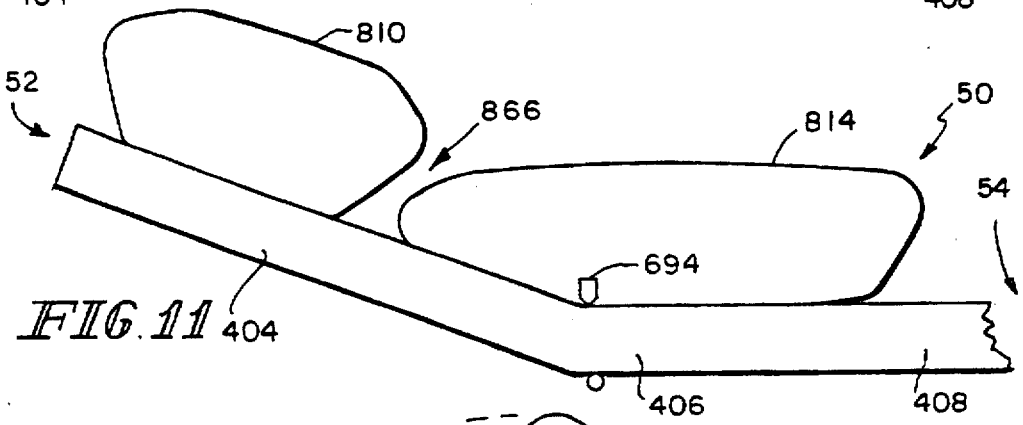
FIG. 11 is a diagrammatic view similar to FIG. 10 showing the head section of the articulating deck of the chair bed raised to an intermediate position of FIG. 7.

Chair bed 50 can be provided with hip pivot guide 694 shown in FIGS. 10–12 to help the caregiver accurately position the hip (not shown) of the person (not shown) on sleeping surface 552. Hip pivot guide 694 indicates the position of the hip of the person that will minimize the distance between effective pivot axis and the axis (not shown) about which the person's hip pivots, thereby maximizing the effectiveness of the reduced-shear pivot. Caregivers providing care to people using conventional beds having movable head sections typically attempt to place the hip of the person at the pivot joint of the head section to the bed. Typically, the only available method for the caregiver to estimate this placement is by viewing the distance between the top of the person's head and the head end of the mattress. Providing hip pivot guide 694 on body section side rails 804, 806 of chair bed 50 maximizes the ability of the caregiver to properly locate the hip of the person on sleeping surface 552.

Head section side rails 808, 810 are mounted to move with head section 404 as head section 404 pivots relative to weigh frame 506 between the down position and the back-support position as shown in FIGS. 10–12. Body section side rails 812, 814 are mounted to weigh frame 506 and do not move relative to weigh frame 506 and seat section 406 when head, thigh, and foot sections 404, 408, 410 of articulating deck 402 move. Head section side rails 808, 810 are shorter than body section side rails 812, 814 and extend only adjacent head section 404, whereas body section side rails 812, 814 extend adjacent head and body (seat and thigh) sections 404, 406, 408. Both of the head section and body section side rails 808, 810, 812, 814 are configured to maintain a between-rail gap 866 of approximately 2–3 inches (5.1–7.6 cm) as head section 404 moves between the back-support position and the down position, as shown in FIGS. 10–12.

In addition, having short head section side rails 808, 810 ideally positions head section side rails 808, 810 to provide support to a person (not shown) entering or exiting chair bed 50 on one of sides 554, 556 when appropriate head section side rail 808, 810 is in the patient-restraining position and body section side rail 812, 814 is in the tucked position. This configuration allows the person to enter and exit by sitting on sleeping surface 552 while holding head section side rail 808, 810 for support, and pivoting off of or onto sleeping surface 552 so that the person does not have to "scoot" along sleeping surface 552. Also, a hip pivot guide 694 on body section side rails 812, 814 helps to optimize the positioning of the hip (not shown) of the person on chair bed 50 after entering chair bed 50 from one of sides 554, 556.

Side rails 808, 810, 812, 814, are passive restraint devices mounted on both sides of chair bed 50 as shown in FIGS. 9, 13, and 14. In the upward patient-restraining position shown in FIG. 13, side rails 808, 810, 812, 814 are vertical barriers abutting sides 554, 556 of mattress 550 and extending above sleeping surface 552 to restrain movement of the person past sides 554, 556 of sleeping surface 552, thereby preventing the person from rolling out of chair bed 50. Side rails 808, 810, 812, 814 may also be lowered below sleeping surface 552 of mattress 550 to a tucked position shown in phantom in FIG. 14 to permit the person to move past sides 554, 556 of sleeping surface 552 when entering or exiting chair bed 50. Lowering side rails 808, 810, 812, 814 also provides the caregiver with clear access to the patient.

Lowering each side rail 808, 810, 812, 814 is accomplished by pulling release handle 862 as shown in FIGS. 13 and 14. After pulling release handle 862, the caregiver may let go of release handle 862 and allow side rail 808, 810, 812, 814 to rotate downwardly into the tucked position. The rate at which each side rail 808, 810, 812, 814 rotates downwardly is preferably controlled by a mechanical damper 868. To raise side rails 808, 810, 812, 814, the caregiver pulls up on side rails 808, 810, 812, 814 until they lock in the patient-restraining position. Side rail assemblies 800, 802, 804, 806 are configured so that side rails 808, 810, 812, 814 are generally vertical and generally parallel to the sides of chair bed 50 at all positions between the tucked position and the patient-restraining position as shown in FIGS. 13 and 14.

Side rail assemblies 800, 802, 804, 806 are of similar construction. The principles discussed below with respect to body section side rail assembly 806 pertain to each side rail assembly 800, 802, 804, 806 unless the description herein specifically states otherwise.

Side rail assembly 806 includes body section side rail 814, a side rail mounting mechanism 816, and a mounting bracket 818 connecting mounting mechanism 816 to sides 508 of weigh frame 506 as shown in FIGS. 13 and 14. Mounting bracket 818 is positioned to lie beneath upper deck 414 and is attached to weigh frame 506 as shown in FIGS. 13 and 14. Similarly, head section side rail assemblies 800, 802 are connected to walls 442, 444 of head section 404, and body side rail assembly 804 is connected to side 508 of weigh frame 506 as shown in FIG. 9.

Mounting bracket 818 includes an upstanding support wall 820 attached to wall 508 of weigh frame 506 and outwardly extending walls 822 attached thereto and attached to weigh frame 506 as shown in FIGS. 13 and 14. Walls 822 of mounting bracket 818 are formed to include upper openings 824 and lower openings 826. Side rail mounting mechanism 816 is a parallelogram connecting mechanism that connects side rail 814 to mounting bracket 818 for movement between the patient-restraining position and the tucked position while maintaining side rail 814 in a generally vertical orientation. Side rail mounting mechanism 816 includes three curved parallel bars 828, 830, 832 having first ends 834, 836, 838, and second ends 840, 842, 844. Curved bar 830 is laterally positioned to lie between curved bars 828, 832 and vertically positioned to lie above curved bars 828, 832. Bracket mounting pins 848 are appended to a first end 836 of curved bar 830 and are rotatably received by upper openings 824 of walls 822. Bracket mounting pins 846, 850 are appended to first ends 834, 838 of curved bars 828, 832 and are rotatably received by lower openings 826 of walls 822. Curved bars 828, 830, 832 are mounted to pivot relative to weigh frame 506.

Curved bars 828, 830, 832 each include a first section extending perpendicular to and above upper deck section 428 and a second section extending transverse to the first bar section below upper deck section 428 when side rail 814 is in the patient-restraining position as shown in FIG. 13. This curved structure in combination with the raised pivot connection to step deck 412 allows side rail 814 to be raised above bottom surface 586 of mattress 550 while being immediately adjacent sides 578 with minimum gap.

Side rail 814 is also formed to include upper openings 852 and lower openings 854 as shown in FIGS. 13 and 14. Side rail mounting pins 858 are appended to second end 842 of curved bar 830 and are received by upper openings 852 of side rail 814. Side rail mounting pins 856, 860 are appended to second ends 840, 844 of curved bars 828, 832 and are received by lower openings 854 of side rail 814. Curved bars 828, 830, 832 are mounted to pivot relative to side rail 814. Upper and lower openings 824, 826 of mounting bracket 818 are spaced apart and upper and lower openings 852, 854 of side rail 814 are spaced apart an equal amount so that curved bars 828, 830, 832 are positioned in parallel relation between side rail 814 and mounting bracket 818.

Side rail 814 can thus rotate between an upper patient-restraining position abutting side 556 of mattress 550 as shown in FIG. 13 to a tucked position beneath section 428 of upper deck 414 shown in FIG. 14 (in phantom). Parallel curved bars 828, 830, 832 cooperate with upper and lower openings 824, 826 of mounting bracket 818 and upper and lower openings 852, 854 of side rail 814 to keep side rail 814 generally parallel to wall 452 of step deck 412 and generally perpendicular to sleeping surface 552 as side rail 814 rotates between the patient-restraining position and the tucked position.

Side rail assembly 806 also includes a latching mechanism 870 including a release handle 862 rotatably mounted to curved bars 828, 832 for movement between a forward latched position shown in FIG. 13 and a rearward released position shown in FIG. 13 (in phantom). Latching mechanism additionally includes links 872 and latches 878, each link having a first end 874 pivotably connected to release handle 862 and a second end 876 that is pivotably connected to a latch 878. Each latch 878 is formed to include a first end 880 that is pivotably connected to curved bars 828, 832, a second end 882 spaced apart from first end 880, a rod-gripper recess 884 adjacent to second end 882, and a spring-receiving opening 886 spaced apart from both ends 880, 882 of latch 878.

Tension springs 888 each have a first end 890 connected to spring-receiving openings 886 of latches 878 and a second end 892 connected to brackets 894 fixed to curved bars 828, 832 as shown in FIG. 13. As release handle 862 is pulled outwardly by the caregiver, release handle 862 pulls links 872 outwardly and upwardly which in turn pull latches 878 upwardly to pivot latches 878 against the bias of springs 888.

A rod 896 is connected to walls 822 of mounting bracket 818 and is arranged to be received by rod-gripper recesses 884 when side rail 814 is in the patient-restraining position shown in FIG. 13 so that rod 896 and latches 878 cooperate to retain side rail 814 in the patient-restraining position. When release handle 862 is pulled outwardly, as shown in phantom in FIG. 13, latches 878 disengage from rod 896, thereby allowing side rail 814 to rotate downwardly as shown in FIG. 14 until side rail 814 reaches the tucked position beneath upper deck 414 of articulating deck 402, as shown for side rail 808 in FIG. 1 and side rail 814 in FIG. 14 (in phantom).

To raise side rail 814, the caregiver simply lifts side rail 814 to rotate side rail 814 upwardly to the patient-restraining position. Each latch 878 has second end 882 having a camming surface 898 as shown in FIGS. 13 and 14 that engages rod 896. As side rail 814 advances toward the patient-restraining position, camming engagement of camming surfaces 898 and rod 896 forces latches 878 to pivot upwardly against the bias of springs 888. Latches 878 ride over rod 896 as side rail 814 advances to the patient-restraining position until rod 896 is adjacent to rod-gripper recesses 884. Springs 888 then pull latches 878 downwardly to capture rod 896 in rod-gripper recesses 884, thereby holding side rail 814 in the patient-restraining position.

Side rail 814 cooperates with side rail mounting mechanism 816 to control the gap between mattress 550 and side rail 814. Because side rail 814 rotates upwardly from the tucked position to the patient-restraining position toward side 556 to abut side 556 of mattress 550, a gap that could form between mattress 550 and side rail 814 is minimized. Additionally, side rail 814 cooperates with step deck 412 to minimize the distance between a bottom 864 of side rail 814 and section 428 of upper deck 414, further maximizing the effectiveness of side rail 814 as a passive restraint. In addition, side rail mounting mechanism 816 provides a one-step release and auto-tuck movement as side rail 814 rotates from the patient-restraining position to the tucked position.

Each side rail assembly 800, 802, 804, 806 operates in a manner similar to side rail assembly 806 described above to move side rails 808, 810, 812, 814 between the tucked position and the patient-restraining position. Head section side rails 808, 810 can additionally be provided with breakaway side rails 920 that move from the tucked position to a generally vertically downwardly extending down-out-of-the-way position described below.

Figure 15:
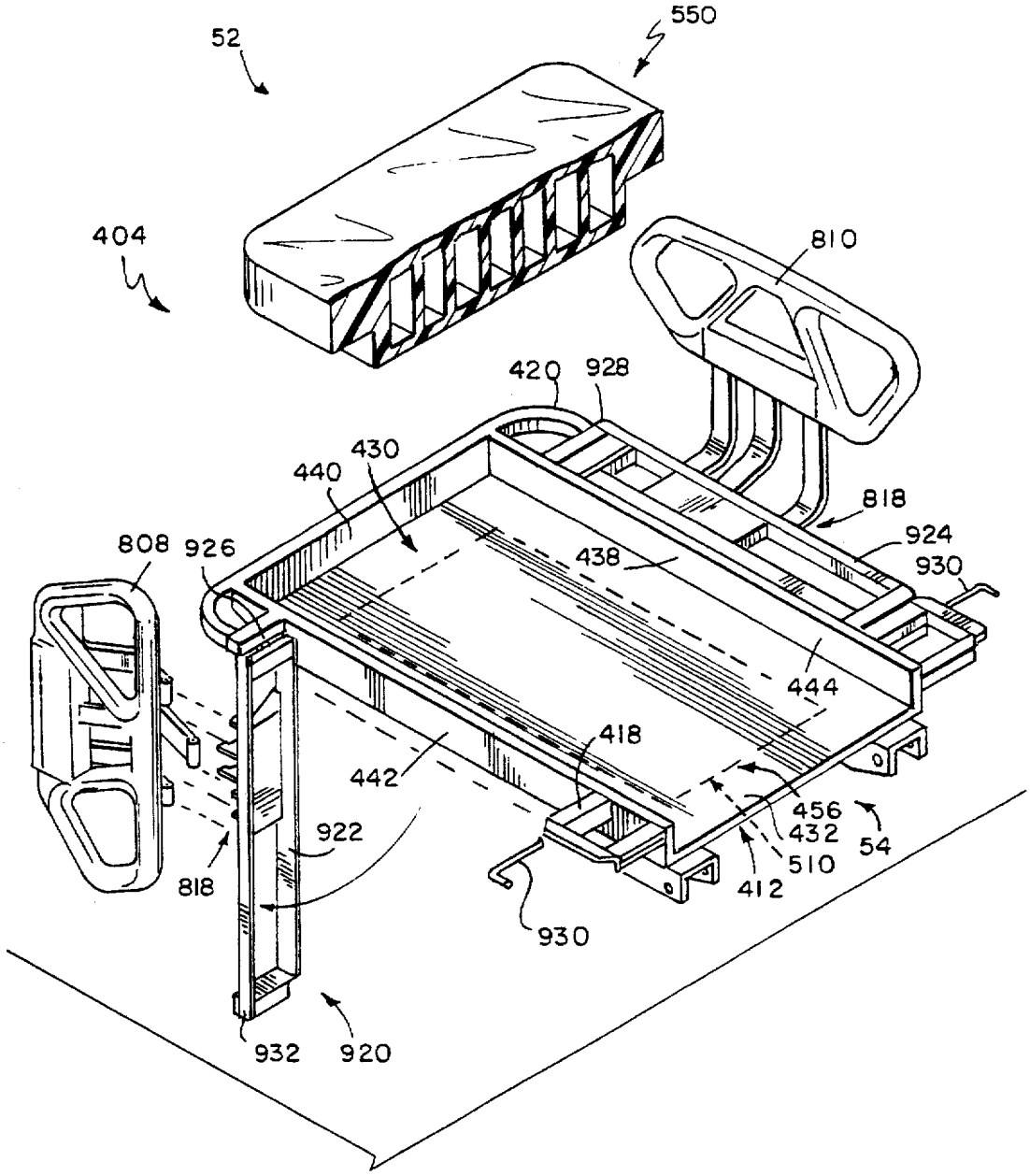
FIG. 15 is an exploded view of a head section of an articulating deck of the chair bed of FIG. 1 including a breakaway side rail.

Breakaway side rails 920 allow the caregiver to move the side rail assemblies from the generally horizontal tucked position to a generally vertically downwardly extending down-out-of-the-way position to provide clear access to chair bed 50 beneath intermediate frame 302 as shown in FIG. 15 and also to provide clear access beneath intermediate frame 302 for equipment mounted on a C-arm. Breakaway side rails 920 accomplish this by moving the side rail to a down-out-of-the-way position away from the side of chair bed 50 and by narrowing the width of the section of chair bed 50 adjacent to the side rail for deeper C-arm insertion.

When chair bed 50 is provided with breakaway side rails 920, head section upper deck side portions 418, 420 include collateral deck members 922, 924 as shown in FIG. 15. Each collateral deck member 922, 924 is pivotably mounted to upper deck side portion 418, 420 by a hinge 926, 928. Each collateral deck member 922, 924 can swing between an up position, as shown, for example, by collateral deck member 924 in FIG. 15, and a generally vertically downwardly extending down-out-of-the-way position, as shown, for example, by collateral deck member 922 in FIG. 15. Preferably, hinges 926, 928 are connected to head end 52 of collateral deck members 922, 924 so that collateral deck members 922, 924 are adjacent to head end 52 of chair bed 50 when collateral deck members 922, 924 are in the down-out-of-the-way position. Each collateral deck member 922, 924 can be locked into the up position by a pin 930 configured to be received by an opening (not shown) in upper deck side portion 418, 420 and an opening 932 in collateral deck member 922, 924.

Mounting brackets 818 are fixed to collateral deck members 922, 924 and are configured to move with collateral deck members 922, 924 so that side rails 808, 810 swing between the generally horizontal tucked position and the generally vertically downwardly extending down-out-of-the-way position when collateral deck members 922, 924 move between the up position and the down-out-of-the-way position as shown in FIG. 15. If desired, head slat 432 can include a radiolucent portion 510 made from a radiolucent material that is transparent to x-rays thereby permitting x-rays to pass therethrough. Radiolucent portion 510 is preferably laterally adjacent collateral head deck members 922, 924. When a caregiver wishes to move head section side rails 808, 810 to the down-out-of-the-way position, such as when preparing chair bed 50 for use during a procedure including the use of equipment mounted on a C-arm, the caregiver can raise intermediate frame 302 to the raised position, rotate the appropriate head section side rail 808, 810 to the tucked position, remove pin 930 from opening 932 in collateral deck member 922, 924 and from the opening (not shown) in upper deck side portions 418, 420, and swing side rail 808, 810 from the tucked position to the down-out-of-the-way position. When collateral deck members 922, 924 are in the down-out-of-the-way position, side rails 808, 810 are longitudinally displaced from radiolucent portion 510 to provide access for fluoroscopic equipment (not shown) above and below deck 402 when head section side rails 808, 810 are moved to the down-out-of-the-way position.

Figure 16:
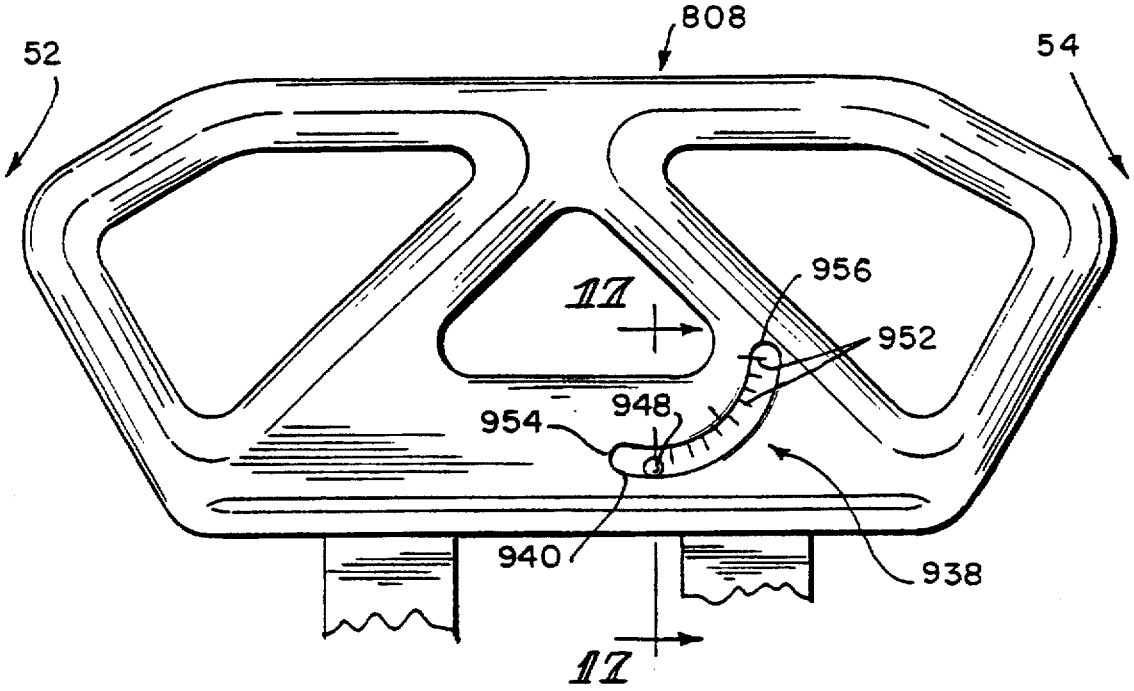
FIG. 16 is a front elevation view from outside of the bed of a head section side rail in accordance with the present invention having a mechanical angle indicator.
Figure 17:
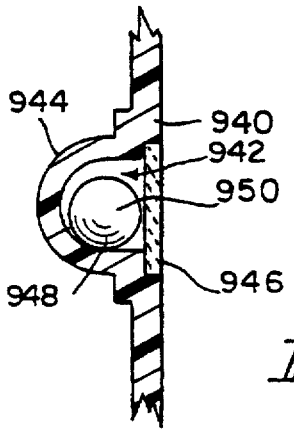
FIG. 17 is a sectional view taken along line 17—17 of FIG. 16 showing the mechanical angle indicator.
Figure 18:
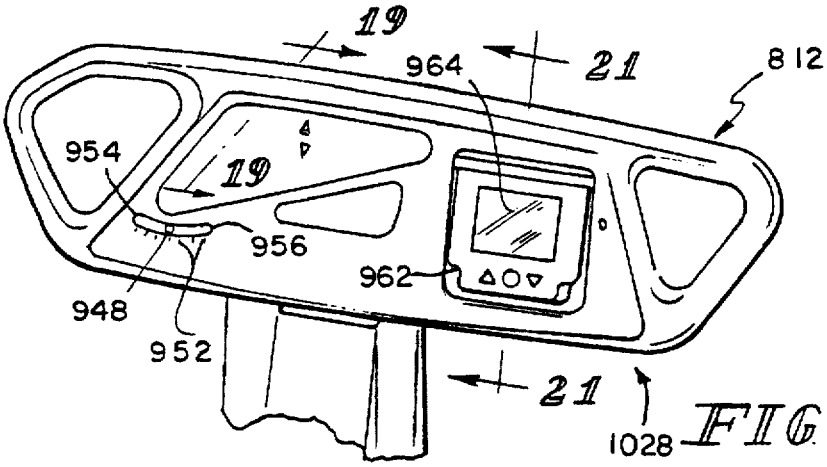
FIG. 18 is a perspective view from outside of the bed of a body section side rail in accordance with the present invention having a mechanical angle indicator and a pivotable display.

Side rails 808, 810, 812, 814 can additionally be provided with angle indicators 938 as shown, for example, in FIGS. 16–18. Head section side rails 808, 810 include indicators 938 as shown in FIG. 16 that generally indicate the angular orientation of head section 404 of deck 402, and body section side rails include angle indicators 938 as shown in FIG. 18 that generally indicate the angular orientation of intermediate frame 302 relative to base frame 62. Thus, angle indicators 938 on body section side rails 812, 814 are sometimes referred to as Trendelenburg indicators or Trend indicators. Mounting angle indicators 938 on side rails 808, 810, 812, 814 prominently displays angle indicators 938 so that the caregiver can quickly and easily judge the status of chair bed 50.

Each angle indicator 938 includes a housing 940 having an interior region 942 defined by a rear wall 944 formed in side rail 808, 810, 812, 814 and a front wall 946 connected to side rail 808, 810, 812, 814 as shown in FIG. 17. An indicator member 948 is received by interior region 942 for movement therein relative to housing 940 as the angular orientation of side rail 808, 810, 812, 814 and angle indicator 938 changes. The position of indicator member 948 relative to housing 940 indicates the angular orientation of angle indicator 938. Housing 940 can be formed so that rear wall 944 is arcuate across the face of side rail 808, 810, 812, 814 as shown in FIG. 16 and indicator member 948 can be spherical and can be positioned to lie on and to roll along arcuate rear wall 944 as the angular orientation of angle indicator 938 changes.

Preferably, indicator member 948 includes an indicator surface 950 that is visible through front wall 946 of housing 940. Markings 952 that are stationary relative to housing 940 can be positioned to lie adjacent to front wall 946 so that markings 952 and indicator member 948 cooperate to indicate the position of indicator member 948 relative to housing 940, thus indicating the angular orientation of side rails 808, 810, 812, 814.

Angle indicator 938 mounted to head section side rail 808, 810 includes a first end 954 positioned to lie toward head end 52 of side rail 808, 810 and a second end 956 positioned to lie toward foot end 54 of side rail 808, 810 and positioned vertically higher than first end 954 as shown in FIG. 16. When head section 404 is in the down position, shown in FIG. 16, indicator member 948 is toward first end 954. When head section 404 moves from the down position to the back-support position, indicator member 948 moves from first end 954 toward second end 956. Indicator member 948 is infinitely positionable relative to housing 940 between first end 954 and second end 956 and the positions of indicator member 948 correspond to positions of head section 404 between the down position and the back-support position.

Angle indicator 938 mounted to body section side rail 812, 814 is substantially identical to angle indicator 938 on head section side rail 808, 760, except that first and second ends 954, 956 are positioned to lie on generally the same horizontal plane as shown in FIG. 18. When intermediate frame 302 is generally horizontal, body section side rail 812, 814 is generally horizontal and indicator member 948 is positioned to lie generally halfway between first end 954 and second end 956. When intermediate frame 302 moves to the Trendelenburg position, intermediate frame 302, body section side rail 812, 814, and angle indicator 938 move so that indicator member moves toward first end 954 of housing 940. When intermediate frame 302 moves to the reverse Trendelenburg position, body section side rail 812, 814 and angle indicator 938 move so that indicator member moves toward second end 956 of housing 940. Indicator member 948 is infinitely positionable relative to housing 940 between first end 954 and second end 956 and the positions of indicator member 948 correspond to positions of intermediate frame 302 between the Trendelenburg position and the reverse Trendelenburg position.

Alternatively, an angle indicator can be a spirit level having a housing filled with a fluid to form a liquid-filled bulb type bubble spirit level. In such a spirit level, the position of the bubble relative to the housing changes as the angular orientation of the spirit level changes, the position of the bubble relative to the housing indicating the angular orientation of the spirit level.

Figure 19:
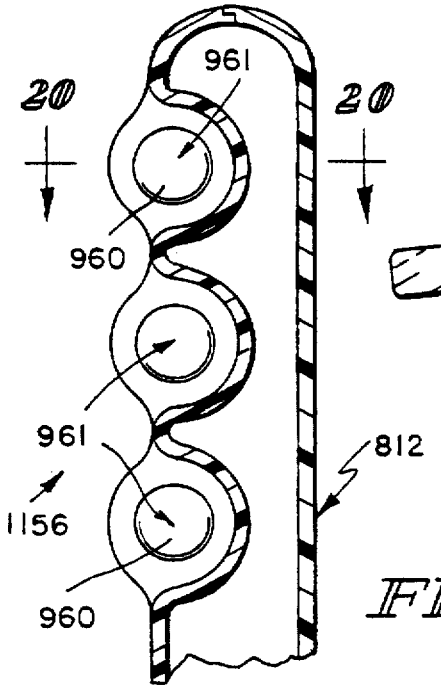
FIG. 19 is a sectional view taken along line 19—19 of FIG. 18 showing the pivotable display.
Figure 20:
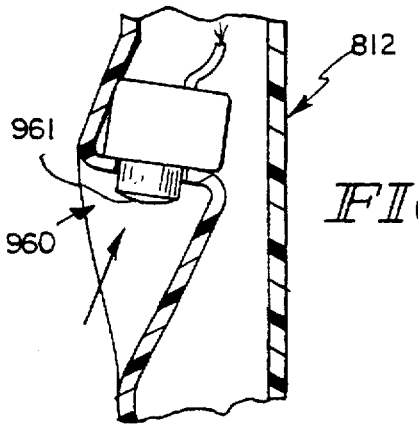
FIG. 20 is a sectional view taken along line 20—20 of FIG. 18 showing the patient control buttons on the inside of the side rail.

Side rails 808, 810, 812, 814 can additionally be provided with controls for operating bed 50 and moving bed 50 to various positions. Controls can include control buttons 960 on a bed side of the side rail 960 for use by a person (not shown) on sleeping surface 550 as shown in FIGS. 19 and 20. Typically, the person's head will rest on head end 52 of sleeping surface 550. To accommodate the person on sleeping surface and allow the person to easily locate and view control buttons 960, control buttons 960 can be angled toward head end 52 of deck 402 as shown in FIGS. 19 and 20 so that faces 961 of buttons 960 are toward head end 52 of deck 402. Bed 50 can also be provided with a second plurality of control buttons (not shown) on an outside of the side rail for use by a person outside of bed 50 as described below.

Figure 21:
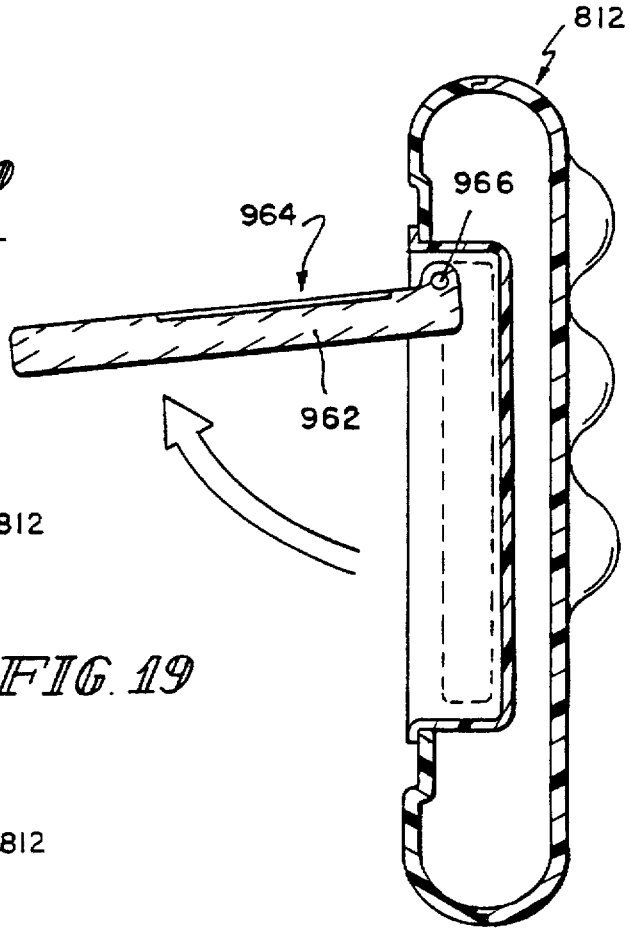
FIG. 21 is a sectional view taken along line 21—21 of FIG. 20 showing the patient control buttons.

Side rail 812 is coupled to the side of deck 402 for movement between the patient-restraining position and the tucked position. A pad 962 having a display screen 964 can be provided on a side of side rail 812 outside of bed 50 as shown in FIGS. 18 and 21 for use by the caregiver. Preferably, pad 962 is mounted to side rail 812 to pivot outwardly for easy viewing of display screen 964 as shown in FIG. 21. For example, pad 962 can be mounted to the outside of side rail 812 and can be configured to pivot upwardly about a pivot axis 966 adjacent to the top of pad 962. This movement of pad 962 particularly allows for easy viewing of display screen 964 by a person standing next to the bed 50 even when side rail 812 is in the tucked position.

Although the invention has been described in detail with reference to preferred embodiments, variations and modifications exist within the scope and spirit of the invention as described and defined in the following claims.

We claim:

1. A chair bed for supporting a person, the chair bed having a head end, a foot end, and opposing sides, said chair bed comprising a frame, a deck supported on the frame, the deck comprising head, seat and foot sections, a mattress on the deck and having an upwardly-facing patient surface and head, seat and foot portions corresponding, respectively, to said head, seat and foot sections of said deck, said head section of said deck and said mattress portion thereon being pivotable from a generally horizontal down position through various positions upwardly to a back-support position, an elongated collateral deck member pivotally coupled to the deck at a first side of the bed for movement about a pivot axis transverse to a longitudinal direction of the bed between an up position generally parallel to the first side of the bed and a generally vertically downwardly extending down-out-of-the-way position, two pairs of side rails one pair on each side of said chair bed, each pair of side rails including a body section side rail mounted to move with said deck seat section and extending laterally adjacent said deck head and seat sections and a head section side rail mounted to move with said deck head section relative to said body section side rail and extending adjacent only said deck head section, and one of the side rail being connected to the collateral deck member and movable with the collateral deck member between the up position and the down-out-of-the-way position.

2. A chair bed according to claim 1, wherein adjacent surfaces of said body and head side rails are configured to maintain a substantially uniform spacing for all positions of the head section of the deck.

3. The chair bed of claim 1, wherein the mattress includes a head, a foot, and opposing sides corresponding to the head, foot, and sides of the chair bed, the patient surface includes side edges adjacent to the sides of the mattress, and each side rail is coupled for movement between a patient-restraining position preventing the movement of the person past the side edges of the patient surface and a tucked position under the deck.

4. The chair bed of claim 3, wherein the side rail includes a top, the deck includes an upper deck, a lower deck, and a side wall connecting the lower deck to the upper deck, and the top of the side rail is positioned to lie in a horizontal plane above the lower deck and below the upper deck when the side rail is in the tucked position.

5. The chair bed of claim 3, wherein the side rails are pivotally mounted to said deck side wall.

6. The chair bed of claim 1, wherein each side rail includes a mounting bracket coupled to the deck a first bar having a first end pivotally coupled to a side rail and a second end pivotally coupled to the mounting bracket, a second bar vertically spaced apart from the first bar, the second bar having a first end pivotally coupled to the side rail and a second end pivotally coupled to the mounting bracket so that the side rail is generally perpendicular to the patient surface when the side rail moves between a patient-restraining position preventing the movement of the person past the side edges of the patient surface and a tucked position under the deck, a rod fixed to the mounting bracket, and a latch pivotally coupled to the first bar for movement between a latched position receiving the rod when the side rail is in the patient-restraining position and a released position away from the rod.

7. The chair bed of claim 6, wherein the latch is yieldably biased toward the first bar so that the latch automatically engages the rod when the side rail is moved from the tucked position to the patient-restraining position.

8. The chair bed of claim 6, wherein each side rail further includes a handle pivotably coupled to the second bar for movement about a handle pivot axis between a latched position and a released position and a link having a first end coupled to the handle at a position spaced apart from the handle pivot axis and a second end coupled to the latch so that the latch moves to the released position when the handle moves to the released position.

9. The chair bed of claim 1, wherein the deck is a step deck having an upper deck and a recess, and said mattress engages said upper deck and has a portion extending into said recess.

10. The chair bed of claim 9, wherein each side rail includes a top and a bottom and is movable between a patient-retraining position which the rail bottom positioned to lie above the upper deck and a tucked position in which the rail top is positioned to lie beneath and tucked under the upper deck.

11. The chair bed of claim 10, wherein the top of the side rail is positioned to lie in a horizontal plane above the bottom of the deck recess when the side rail is in the tucked position.

12. The chair bed of claim 1, further comprising an angle indicator mounted on one of the side rails to indicate the angular orientation of the side rail relative to the floor.

13. The chair bed of claim 12, wherein the angle indicator includes a housing having an arcuate wall defining an interior region and an indicator member movably received in the interior region visible through the housing to indicate the orientation of the side rail.

14. The chair bed of claim 1, wherein one of said side rails includes a first plurality of first control buttons on a bed side of said rail for use by a person in said bed and a second plurality of second buttons on an outside of said rail for use by a person outside said bed.

15. The chair bed of claim 14, wherein said second plurality of buttons is greater than said first plurality, and said second buttons perform the same function as said first buttons as well as additional functions.

16. The chair bed of claim 14, wherein a face of said first buttons are inclined with respect to a horizontal plane of said side rail toward the head of said bed for ease of viewing by a person in said bed.

17. The chair bed of claim 14, including a display screen on said outside of said rail.

18. The chair bed of claim 17, wherein said display screen is mounted to said rail to pivot out for ease of viewing from above said side rail.

19. A bed having a head end, a foot end and sides, the bed comprising a deck and a mattress on said deck, said deck including an elongated collateral deck member pivotally coupled to the deck at a first side of the bed for movement about a pivot axis transverse to a longitudinal direction of the bed between an up position generally parallel to the first side of the bed and a generally vertically downwardly extending down-out-of-the-way position, and a side rail connected to the collateral deck member and movable with the collateral deck member between the up position and the down-out-of-the-way position.

20. The bed of claim 19, wherein a head end of the collateral deck member is pivotally coupled to the first side of the bed so that a foot end of the collateral deck member swings towards the head end of the bed when moving from the up position to the down-out-of-the-way position.

21. The bed of claim 20, wherein the collateral deck member includes a lug at its foot end having a first pin-receiving opening, the deck includes a wall having a second pin-receiving opening, and a pin extending through the first and second pin-receiving openings when aligned to lock the collateral deck member in the up position.

22. The bed of claim 19, wherein the mattress includes a head, a foot, and opposing sides corresponding to the head, foot, and sides of the bed, the patient surface includes side edges adjacent to the sides of the mattress, and said side rail is coupled to said collateral deck member for movement between a patient-restraining position preventing the movement of the person past the side edges of the patient surface and a tucked position under the deck.

23. The bed of claim 19, wherein the side rail includes a mounting bracket coupled to the deck a first bar having a first end pivotally coupled to the side rail and a second end pivotally coupled to the mounting bracket, and a second bar vertically spaced apart from the first bar, the second bar having a first end pivotally coupled to the side rail and a second end pivotally coupled to the mounting bracket so that the side rail is generally perpendicular to the patient surface when the side rail moves between the patient-restraining position and the tucked position.

24. The bed of claim 23, wherein the side rail includes a rod fixed to the mounting bracket and a latch pivotally coupled to one of the first and second bars and configured to receive the rod when the side rail is in the patient-retraining position.

25. The bed of claim 19, wherein the deck is a step deck having an upper deck and a recess, said collateral deck member is part of the upper deck, and said mattress engages said upper deck and has a portion extending into said recess.

26. The bed of claim 25, wherein the side rail includes a top and a bottom and is movable between a patient-retraining position having the rail bottom positioned to lie above the upper deck and a tucked position in which the rail top is positioned to lie beneath and recessed under the upper deck.

27. The bed of claim 26, wherein the top of the side rail is positioned to lie in a horizontal plane above the bottom of the deck recess when the side rail is in the tucked position.

28. The bed of claim 19, further comprising an angle indicator mounted on one of the side rail to indicate the angular orientation of the side rail relative to the floor.

29. The bed of claim 28, wherein the angle indicator includes a housing having an arcuate wall defining an interior region and an indicator member movably received in the interior region visible through the housing to indicate the orientation of the side rail.

30. The bed of claim 19, wherein the deck includes a radiolucent portion laterally adjacent the collateral deck member.

31. The bed of claim 30, wherein the side rail is positioned so that the side rail is longitudinally displaced from the radiolucent portion to provide access for fluoroscopic equipment above and below the deck when the side rail is moved to the down-out-of-the-way position.

32. The bed of claim 30, wherein the deck includes a head section adjacent to the head of the bed and the radiolucent portion and the collateral deck member are in the head section of the deck.

33. The bed of claim 32, wherein the deck head section is movable between a generally horizontal down position and an upward back-support position providing a pivotable backrest.

34. The bed of claim 19, wherein the deck includes a head section, a seat section and a foot section, the collateral deck member is in the head section of the deck, and the head section is movable between a generally horizontal down position and an upward back-support position providing a pivotable backrest.

35. The bed of claim 34, wherein the head section is slidably mounted relative to the seat section so that the head section moves rectilinearly away from the seat section and pivots upwardly when the head section moves from the down position to the back-support position.

36. The bed of claim 34, including a body section side rail coupled to the bed adjacent to the seat section and extending laterally adjacent to the deck head and seat sections, and the head section side rail and the body section side rail are configured so that the head section side rail moves with the head section of the deck without contacting the body section side rail.

37. A bed comprising:

a base;

a deck mounted on said base and including at least head, seat and foot sections movable relative to each other;

a mattress over the deck and having an upwardly-facing sleeping surface and head, seat and foot portions corresponding, respectively, to said head, seat and foot sections of said deck; and a label adhered to the deck adjacent a juncture of said head and seat sections of said deck and indicating a desired longitudinal position of the hip of a patient on the deck.

38. The chair bed of claim 37, further comprising a side rail coupled to the deck and the indicia is fixed to the side rail.

39. The chair bed of claim 38, wherein the side rail has a first side facing inwardly toward the sleeping surface and the indicia is fixed to the first side of the side rail.

40. The chair bed of claim 37, wherein the head section pivots relative to the seat section about an effective pivot axis positioned to lie above the sleeping surface and the indicia is positioned to lie so that the indicia indicates the position of the hip of the person that will minimize the distance between the effective pivot axis and the axis about which the person's hip pivots to reduce the scrubbing of the sleeping surface against the person.

41. The chair bed of claim 37, wherein the indicia includes a label adhered to the moveable deck structure.

* * * * *